United States Patent [19]

Broyles

[11] 3,992,918

[45] Nov. 23, 1976

[54] NAIL STRAIGHTENER

[76] Inventor: David R. Broyles, 1032 Ohio, Lawrence, Kans. 66044

[22] Filed: Oct. 15, 1975

[21] Appl. No.: 622,504

[52] U.S. Cl. ..... 72/416; 29/401 R; 72/357; 72/472

[51] Int. Cl.[2] ..... B21D 3/10

[58] Field of Search ..... 72/357, 470, 413, 472, 72/412, 413, 416, 386, 452; 140/147; 29/401 R

[56] References Cited

UNITED STATES PATENTS

| | | | |
|---|---|---|---|
| 2,183,702 | 12/1939 | Wendel | 72/357 |
| 2,278,293 | 3/1942 | Watson | 72/357 |

FOREIGN PATENTS OR APPLICATIONS

| | | | |
|---|---|---|---|
| 920,703 | 11/1954 | Germany | 72/386 |
| 1,078,548 | 8/1967 | United Kingdom | 140/147 |

*Primary Examiner*—C.W. Lanham
*Assistant Examiner*—Gene P. Crosby

[57] ABSTRACT

A nail straightening device comprising two grooved elements and wedging means to move said grooved elements toward each other.

3 Claims, 3 Drawing Figures

FIG. 1.
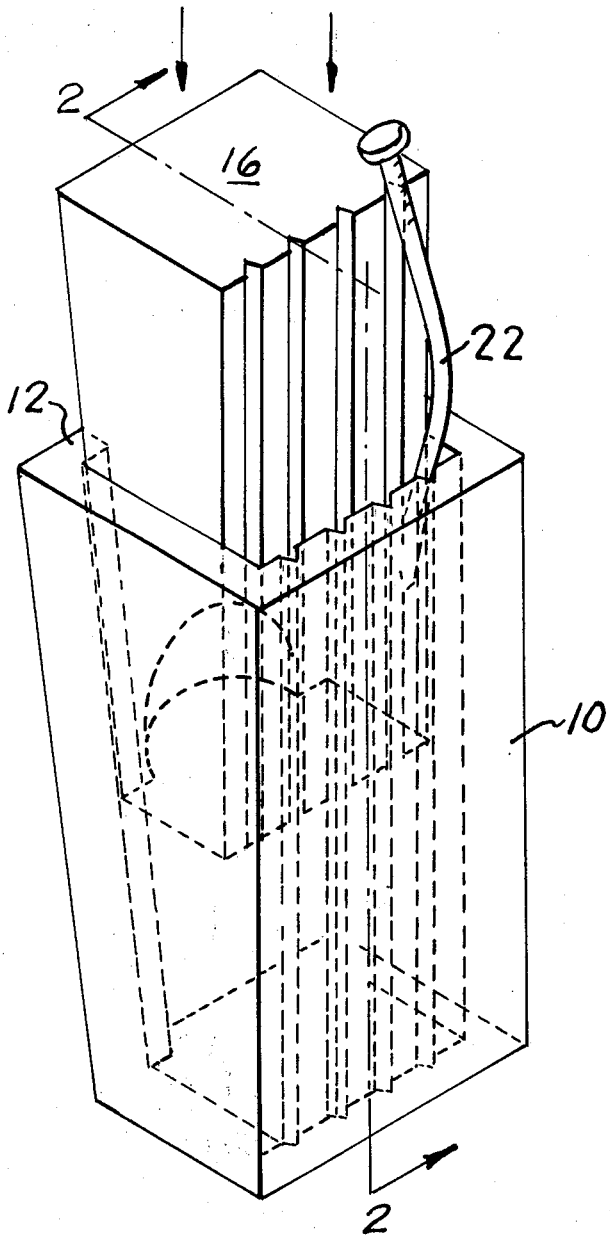
FIG. 2.
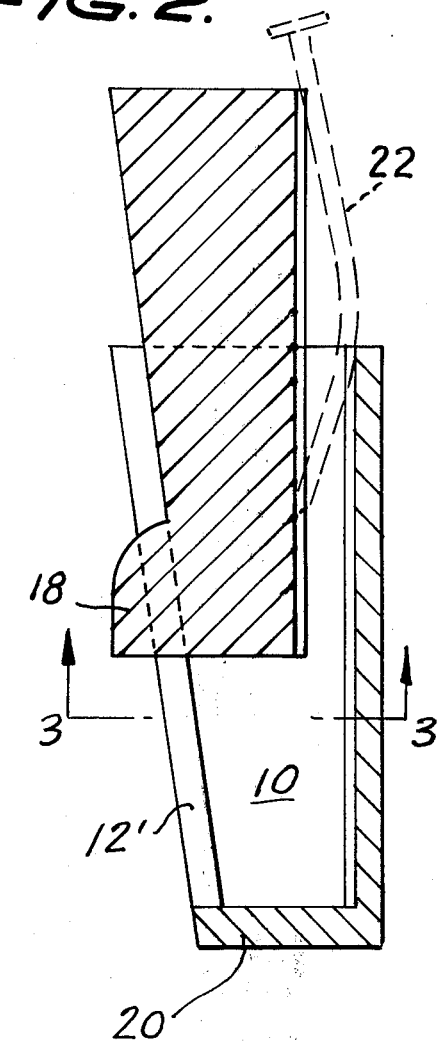
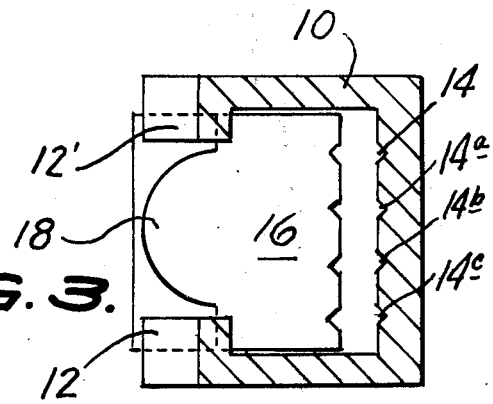
FIG. 3.

NAIL STRAIGHTENER

BACKGROUND OF THE INVENTION

Field of the Invention

Bent nails are almost invariably bent in a curve lying substantially in a plane. In attempting to straighten such bent nails it is usual to place the nail on a hard surface with the curve of the nail rising from the surface and striking the curve with a hammer.

The result of this common practice results in nails that are still not straight, or that are even bent slightly in the opposite direction due to being supported by the nail head when the nail is struck. Also, due to the difficulty of holding the nail in position it may turn, so not be straightened at all or the fingers holding the nail may be hurt.

It is an object of the present invention therefore to provide a nail straightening device which will straighten nails with a minimum of effort and with a high degree of accuracy.

Other and further objects and advantages will appear from the following specification taken with the accompanying drawing in which like reference characters refer to similar parts in the several views.

BRIEF DESCRIPTION OF THE DRAWINGS

FIG. 1 is a perspective view of the nail straightener; FIG. 2 is a section taken on line 2—2 of FIG. 1; and FIG. 3 is a section taken on line 3—3 of FIG. 2.

DESCRIPTION OF THE PREFERRED EMBODIMENT

FIGS. 1 and 2 show an outer element 10 which I designate as an anvil element that is of generally rectangular U-shaped section tapering from top to bottom and as seen in FIG. 3 with the areas of the U turned inwardly at 12, 12' to form wedging surfaces. The flat bottom of the U-shaped anvil element is provided with at least one, but preferably several grooves **14, 14*a*, 14*b*, 14*c*** extending along its length. These grooves may preferably have different depths to accommodate different sized nails.

A die or wedge element 16 is shaped to be complementary to the inside of anvil element 10. That is, as die or wedge element 16 is moved into the cavity in element 10 it is moved by wedge action against turned-in flanges 12, 12' toward the flat bottom of the U-shaped cavity in element 10. When fully within element 10 one surface of die element 16, which may be termed the die surface, will contact the inner grooved surface of the bottom wall of anvil element 10. The die surface of element 16 is formed with grooves **15, 15*a*, 15*b* and 15*c* corresponding with grooves 14, 14*a*, 14*b* and 14*c* both as to size and location. A lug 18 may conveniently be provided on the side of die element 16 remote from its die surface at the smaller end of die element 16 which is convenient to help remove the die or wedge from the anvil. The bottom or smaller end of anvil element 10 may be closed at 20 for the sake of strength, or may be open to facilitate driving element 16 out of element 10.**

After the wedge element 16 has been driven home to straighten a nail it will now be possible to withdraw element 16 from element 10. The device is then turned over and the lug 18 is struck sharply while element 10 is restrained and wedge 16 will be driven sufficient out of element 10 as to permit removal of the straightened nail 22.

Having thus described the preferred embodiment of the invention it should be understood that numerous structural modifications and adaptations may be resorted to without departing from the spirit of the invention.

What is claimed is:

1. A nail straightener comprising a fixed anvil having a flat surface and at least one groove extending longitudinally thereon, a die element having a flat surface and having a longitudinal groove in said die surface corresponding to the groove in said anvil element, a wedge surface at an angle to and opposite said anvil surface, said die having a wedge surface to contact the wedge surface opposite to said anvil at the same angle to said die surface as its angle between said wedge surface opposite said anvil and the flat surface of said anvil element whereby a bent nail placed with its ends in one of said grooves and the bend in the nail in the other of said grooves in said die and anvil elements may be straightened by wedging said die element toward said anvil element.

2. The nail straightener of claim 1 in which a striking lug is provided on said die element to receive hammer blows to separate said anvil and die after use.

3. The nail straightener of claim 1 in which said anvil element is of substantially rectangular U form of varying depth along its length and with the ends of the arms of the U section being inturned to provide the said wedge surface opposite said anvil surface.

* * * * *